United States Patent [19]

Moen

[11] 4,095,554

[45] Jun. 20, 1978

[54] SELF-WIPING, SELF CONTROLLED FLUID DISPENSER APPARATUS

[76] Inventor: Lenard E. Moen, 7914 Michigan, Whittier, Calif. 90602

[21] Appl. No.: 735,274

[22] Filed: Oct. 26, 1976

Related U.S. Application Data

[63] Continuation of Ser. No. 584,907, Jun. 9, 1975, abandoned, which is a continuation-in-part of Ser. No. 366,629, Jun. 4, 1973, abandoned.

[51] Int. Cl.[2] ..... B05C 5/02; B05C 11/10

[52] U.S. Cl. ..... 118/3; 118/411

[58] Field of Search ..... 118/2, 3, 410, 411, 118/DIG. 3; 222/146 HE, 402.22, 146

[56] References Cited

U.S. PATENT DOCUMENTS

| | | | |
|---|---|---|---|
| 3,088,433 | 5/1963 | Walter et al. | 118/411 X |
| 3,190,259 | 6/1965 | Craig et al. | 118/2 |
| 3,425,393 | 2/1969 | Shuh et al. | 118/2 |

*Primary Examiner*—Dorsey Newton

*Attorney, Agent, or Firm*—Frederick E. Mueller

[57] ABSTRACT

A fluid dispenser and a support shoe are mounted to bear on opposite sides of a box blank passing therebetween. A normally closed valve of a nozzle of the dispenser has means yieldably biasing the nozzle to a normal position to intercept a leading edge of a box blank to open the valve upon deflection of the nozzle. A predetermined longitudinally spaced-apart gap relationship of the nozzle and support shoe effects return of the nozzle to normal position and closing of the valve, in response to the nozzle biasing means, concurrently with a trailing edge of the box blank leaving the support shoe, to wipe the closed nozzle clean on a deflected trailing end portion of the box blank. Alternatively, the support shoe may be rockably mounted for movement to a retracted position providing clearance for deflection of the trailing end portion of the box blank by the nozzle biasing means. An automatically controlled pneumatic power system may be employed for moving the rockable shoe between extended and retracted positions, synchronously with movement of box blanks therepast, for a skip pattern delivery of fluid.

23 Claims, 15 Drawing Figures

SELF-WIPING, SELF CONTROLLED FLUID DISPENSER APPARATUS

This application is a continuation of application Ser. No. 584,907 filed June 9, 1975, now abandoned, which was a continuation-in-part of prior application Ser. No. 366,629 filed June 4, 1973; now abandoned.

SUMMARY OF THE INVENTION

A dispenser assembly includes a pivotally mounted dispenser nozzle, a box blank support shoe, and a deflection shoe affixed to the upstream side of the assembly. The support show is longitudinally aligned with the nozzle and positioned a predetermined gap distance upstream from the nozzle, the latter being valve controlled by a spring mechanism that also biases the normally closed nozzle into the plane in which the box is fed through the dispenser. Deflection of the nozzle by the leading edge of a box blank passing downstream opens the valve to deposit a bead of glue on a surface of the box blank. Upon the trailing edge of the box blank leaving the downstream end of the support shoe the spring mechanism of the dispenser nozzle deflects a marginal trailing edge portion of the box blank and simultaneously effects closing of the valve means of the dispenser nozzle. As a result the applicator nozzle is wiped clean by a marginal trailing edge portion of the box blank and no excess glue can be strung out and deposited on working parts of the machine.

Alternatively, the support shoe is rockably mounted and normally biased with its downstream end, adjacent the nozzle, away from the nozzle and into an inoperative position. A pneumatic means effects movement of the support shoe into an operative position constraining the leading edge of a box blank into a path of movement for pivotal actuation and opening of the dispenser nozzle. At a predetermined point in the passage of the box blank over the support shoe the pneumatic power means is de-energized permitting the spring biased support shoe to retract to its inoperative position prior to the trailing edge of the blank passing downstream beyond the nozzle. The spring mechanism of the dispenser thereupon deflects the box board, effecting closing of the valve mechanism, whereupon the applicator nozzle is wiped clean upon a biased, marginal trailing edge portion of the box blank.

In a multiple dispenser assembly wherein it is desired to skip the application of beads of glue to opposite end flaps of a box blank, and/or intermediate portions of a flap, the deflection shoe is adapted to bias the box blank out of the plane of operative engagement with longitudinally spaced nozzles and each of the support shoes is both spring biased and pneumatically driven in the manner previously indicated. An adjustable air choke or restrictor is interposed between the individual actuating cylinders for each of the support shoes for effecting a selectively controllable time delay in the extension and retraction of each of the support shoes between operative and inoperative positions. A pair of sensor elements, responsive to passage of the leading and trailing edges of a box blank relative thereto, are employed to energize and de-energize the restrictively interconnected pneumatic cylinders for a timed interval corresponding to that portion of the length of the box blank onto which the delivery of glue stripes is desired.

DESCRIPTION OF THE PREFERRED EMBODIMENTS

Figure 1:
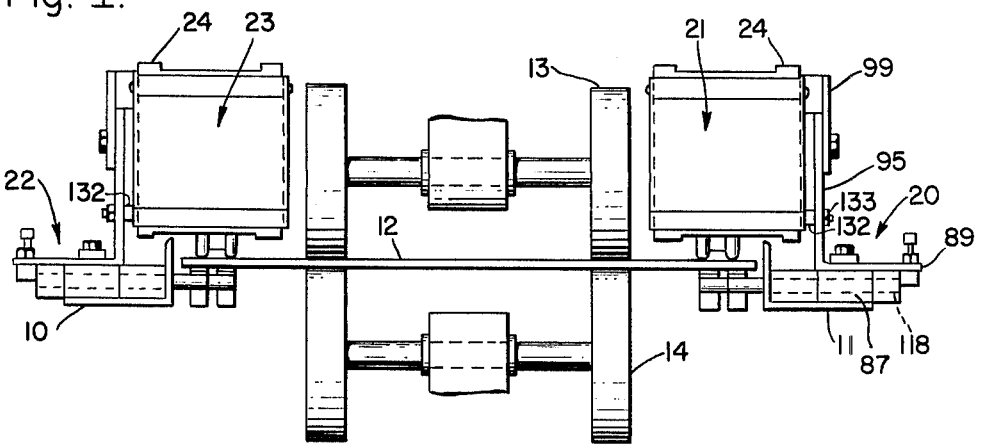
FIG. 1 is a schematic elevational end view of a box making machine incorporating one embodiment of the invention.

FIG. 1 schematically represents a box making machine equipped with self wiping dispenser apparatus of this invention. While not illustrated, it is to be understood that the machine has the usual framework including a pair of rigidly supported angle iron guide members 10 and 11 that are laterally adjustable to accomodate different widths of box blanks 12 to be processed by the machine. The vertically upstanding flanges of the guides 10 and 11 serve as guides for the opposite edges of each box blank. In order to feed the blanks 12 through the machine it may be equipped, for example, with sets of rollers 13 and 14 engagable with upper and lower sides, respectively, of each box blank 12. It will be further understood that the sets of rollers 13 and 14 are provided at spaced longitudinal intervals on the machine framework. As is indicated in FIG. 2, the fluid dispenser apparatus is mounted in a longitudinal gap between adjacent sets of rollers 13 and 14.

In order to apply cold or hot glue to the opposite side margins of each box blank 12, a glue dispensing apparatus is disposed on each of the two sides of the machine. Thus, referring to the right-hand side of FIG. 1, a bracket assembly 20 is secured to the upper face of the horizontal flange of the guide member 11 in order to support a dispenser assembly 21 over the corresponding margin of a box blank 12. Similarly, on the opposite side of the machine there is a bracket assembly 22 secured to the horizontal flange of the guide member 10 in order to support a dispenser assembly 23 over the corresponding margin of a box blank 12. Both of the dispenser assemblies 21 and 23 incorporate dispenser bodies 24 and each body 24 mounts an identical pair of glue guns, generally indicated by the numeral 25.

Figure 2:
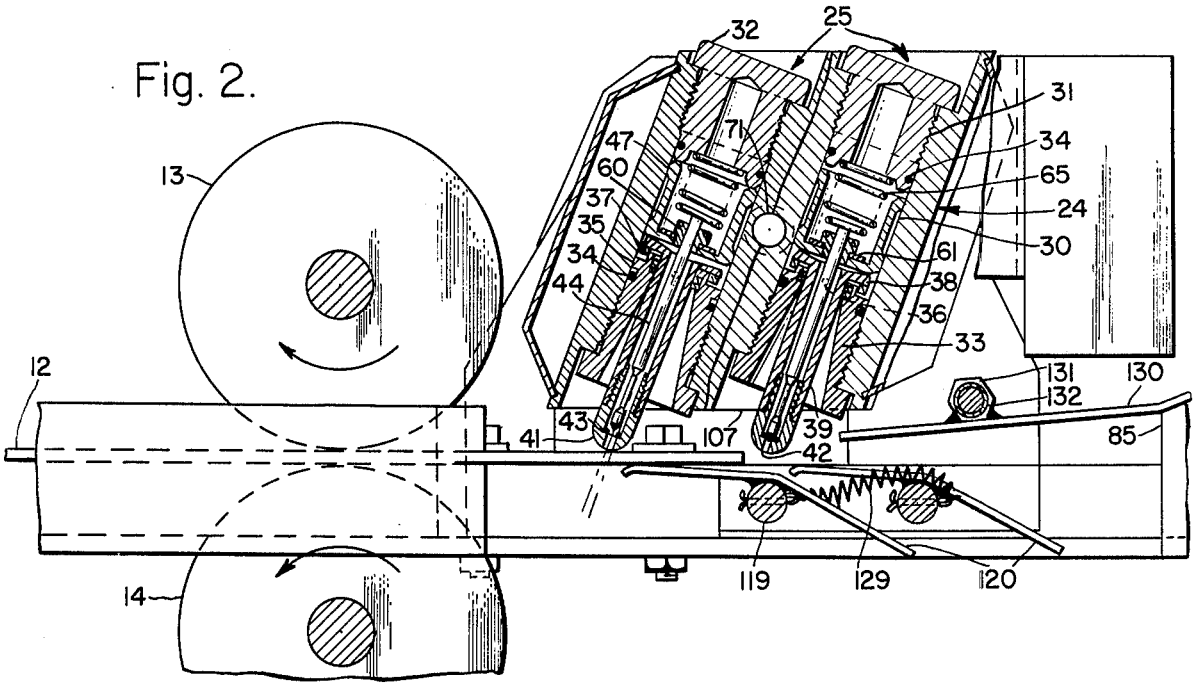
FIG. 2 is a partial side elevational view, on a larger scale, partly in section, of the fluid dispenser apparatus of the embodiment of FIG. 1.

Referring to FIG. 2, the body 24 is formed with a parallel pair of through bores 30 for mounting a pair of glue gun assemblies 25. The bores 30 are arranged in laterally offset or staggered tandem relationship in order to accomodate a pair of guns within a minimum volume size of the body 24. Each of the gun assemblies 25 may be either of the type disclosed in my U.S. Pat. No. 3,273,757 of Sept. 10, 1966 or my U.S. Pat. No. 3,854,631 issued on Dec. 17, 1974. Since the type of the latter patent is illustrated in the drawings, that patent is hereby incorporated by reference thereto as though fully set forth herein at this point.

Each dispenser assembly 25 includes a flow adjusting plug 32 and an actuator retainer 33, each being formed with an external section that is threaded for engagement with either of the sets of threads 31 at opposite ends of the bore 30. In order to provide a fluid seal each of the parts 32 and 33 is adapted to mount an appropriate O-ring seal 34.

At is inner end, retainer 33 is formed with an annular shoulder 35 to which a diametrically opposite coxially aligned pair of pivot pins 36 are secured in a manner to protrude from the radial surface of the shoulder. The pair of pins 36 rockably support a wear ring 37 which, in turn, acts as a seat for a radially outwardly extended flange 38 that is integrally formed on the inner end of a tubular actuator barrel 39. As is indicated in FIG. 2, the arrangement is such that the pivot axis defined by the pins 36 is at 90°, or normal, to the direction of flow of the box blanks 12 through the machine.

The lower end of the actuator barrel 39 is provided with a nozzle 41 having an outlet orifice 42. Within the nozzle 41 there is a valve seat member 43 that is normally closed by the head of a valve stem 44 whose rear end is operatively interconnected to a spool 47 that is axially slidably mounted in its bore 30 for reciprocation within the limits imposed by the opposing end faces of the retainer 33 and the flow adjusting plug 32. Thus, the rear end of valve stem 44 mounts a lock nut 60 which bears against a concentric washer 61 that, in turn, bears against the inside of a forward end wall of the spool. A spring 65, biased between the plug 32 and the nut 60, normally maintains the valve in the position indicated in the right-hand one of the dispensers 25 of FIG. 2 whereby the orifice of the nozzle is closed. Upon the actuator barrel 39 being deflected by the leading edge of a box blank 12, the parts are cammed to the open position of the valve illustrated in the left-hand one of the dispensers 25 in FIG. 2.

While not illustrated, it will be understood that the body 24 is in communication with a source of glue and for this purpose is internally formed with a bore 71 that is in fluid communication with the pair of bores 30 holding the pair of glue guns 25. Also, while not specifically illustrated, it will be understood that when used for the application of hot glue, the body 24 is provided with means for the reception of resistance heating elements, a temperature sensing element, and a thermocouple or like means for controlling the temperature of the dispenser body.

Each of the dispenser assemblies 21 and 23 is held in operative position by means of the bracket assembly 20 or bracket assembly 22, respectively. These bracket assemblies may be mirror images of one another and only one will be generally described, reference being made to my co-pending application Ser. No. 584,908 for constructional details thereof.

The angle iron guide member 11 is formed with a window 85 in its upstanding flange in the region where it is desired to mount the dispenser assembly 21, for example. The horizontal flange of the angle member 11 adjacent to this window has a mounting block 87 secured thereto on which the horizontal flange of an angle member 89 is connected. Angle member 89 is formed with an upstanding flange 95 to which the dispenser assembly 21 is interconnected via an L-shaped member 99. A window 107 in the flange 95 permits viewing of the nozzles 41 for adjusting the support shoes relative thereto, as will later appear.

The bracket assembly also supports a pair of support shoes 120 for engagement with the underside of box blanks passing thereover in a manner for adjustment of the shoes relative to the dispenser nozzles with which they are operatively associated. For this purpose the horizontal flange of the angle member 89 is formed with an aligned pair of longitudinally extended slots to receive a pair of bolt fasteners 116 interconnected to support shoe mount 117 carried beneath the member 89. As will be apparent, mounting block 117 thus can be shifted longitudinally relative to the member 89 and thereafter clamped to a desired adjusted position. The mounting block 117 is provided with a parallel pair of transverse bores 118 in order to journal a pair of shafts 119. As is seen in FIG. 2, the inner ends of the pair of shafts 119 have angularly shaped support shoes 120 rigidly affixed thereto and each of these shoes has a downstream projecting free end in proximity to one of the dispenser nozzles. The support shoes 120 are arranged in the same staggered tandem relationship as are the dispenser assemblies 25, each of the shoes being in longitudinal alignment with its associated dispenser nozzle.

Figure 3:
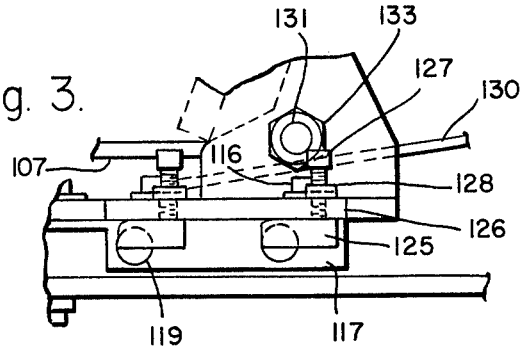
FIG. 3 is a partial side elevational view of a portion of the bracket assembly for the dispenser of FIG. 2.

The support shoes 120 can be adjusted in unison to achieve a desired longitudinal gap between the free end of each shoe and its associated dispenser nozzle by shifting the mounting block 117 relative to the angle bracket 89, as is shown in FIG. 3. In addition, each of the support shoes 120 is individually adjustable to vary the vertical gap between its downstream free end and its associated dispenser nozzle in order to accomodate different thicknesses of sheet material being worked by the apparatus. For this purpose, each of the shafts 119 has a dog 125 rigidly affixed to its outer end to be pivoted as a result of rotation of the shaft. The block 117 has a stop plate 126 secured to one marginal edge thereof in a position to overly the pair of dogs. A longitudinally spaced pair of adjusting screws 127, threadedly mounted in tapped bores of the stop plate 126, at their lower ends engage free ends of the pair of dogs 125. Accordingly, the downstream free ends of the support shoes 120 are positively limited against counterclockwise rotation to a degree dependent upon the adjustment of the screws 127. In order to bias each of the dogs against its associated stop a tension coil spring 129 is interconnected between the shafts 119 as indicated in FIG. 2. By this means the gap between each of the applicator nozzles and its associated support shoe 120 can be adjusted to the thickness of the box or sheet material being processed.

For guiding the leading edge of a box blank into the gap between the support shoes 120 and the dispenser nozzles the bracket assembly also mounts an elongate deflection shoe 130. This shoe may conveniently be made from a length of strap metal bent to the profile shown in FIG. 2. In order to mount the deflection shoe to the bracket assembly the head of a bolt 131 is welded or otherwise secured thereto, the threaded shank of which extends through a sleeve 132 and through an opening is the upstanding flange 95 of the angle member 89. A nut 133 threadedly engages the outer end of the bolt 131 by means of which the sleeve and, consequently, the shoe can be clamped in a desired adjusted position of the shoe. Thus, if it is desired to adjust the downstream end of the shoe vertically the nut 133 can be loosened to pivotally adjust the shoe to the desired position, after which the nut can be resecured.

Referring to FIG. 2, it will be seen that when a box blank is driven into the gap between the deflection shoe 130 and the pair of support shoes 120 that the leading edge of the blank successively engages the nozzles of the actuator barrels of the two dispenser assemblies. As a result each barrel is deflected through the arc indicated for the left-hand dispenser assembly 25, effecting opening of the outlet orifice to deliver a stream of glue deposited as a bead on the upper surface of the box blank. Accordingly each of the dispenser assemblies delivers glue onto a surface of the box blank substantially simultaneously with engagement of the leading edge of the box blank with a nozzle of a dispenser assembly.

Figure 2A:
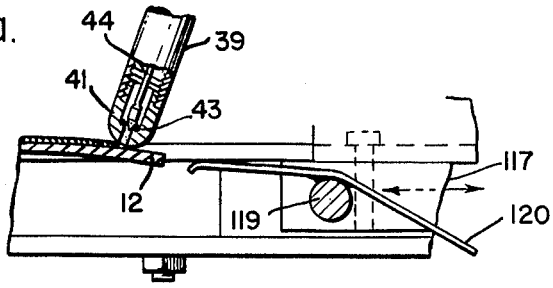
FIG. 2*a* is a partial elevational view, similar to FIG. 2, showing another adjusted position of one of the support shoes relative to its associated applicator nozzle, the nozzle being depicted in a valve closed position and in wiping action relationship to a marginal trailing edge portion of the box blank proceeding thereunder.
Figure 6:
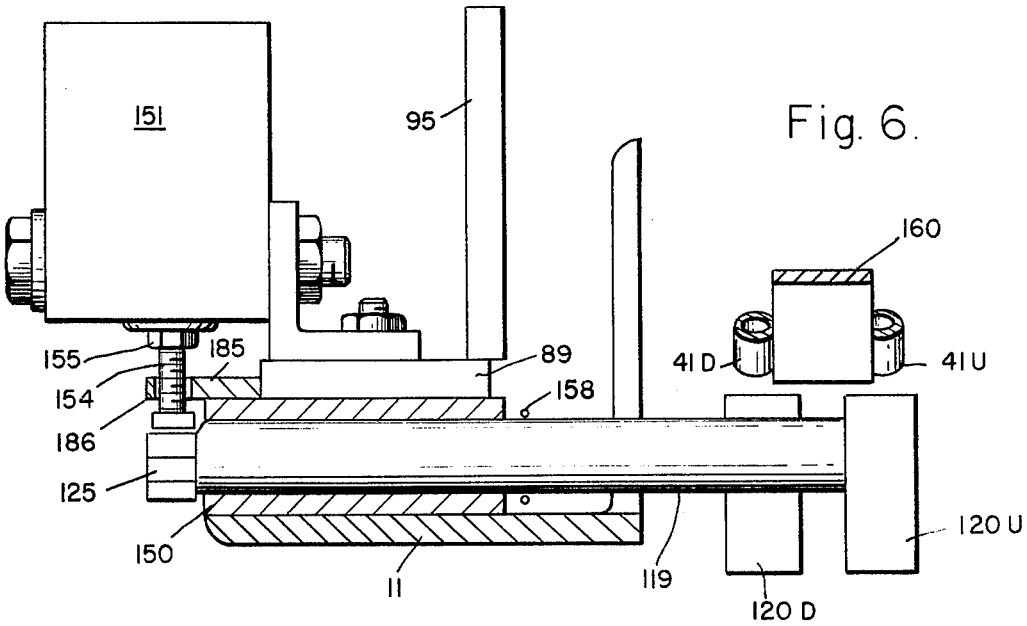
FIG. 6 is an end elevational view of the dispenser assembly of FIG. 5.

On the other hand, and especially with hot glues, it is desirable to close the valve of each dispenser assembly prior to the moment at which the nozzle thereof leaves the trailing end marginal portion of the box blank. Such an arrangement insures that excess glue is not delivered through the outlet nozzle in the interval between box blanks and, in addition, provides a period in which the dispenser valve is closed while the nozzle thereof is wiped clean by the trailing marginal portion of the box blank. This is accomplished by the longitudinal gap spacing between the downstream free end of each support shoe 120 and its associated dispenser nozzle. Thus, as is shown in FIG. 2*a*, upon the trailing edge of the box blank 12 leaving the downstream end of a support shoe 120 the spring 65 of the associated dispenser 25 effects closing of the dispenser nozzle by returning the actuator barrel 39 to the normal position, slightly deflecting the free trailing end portion of the box blank 12 downwardly. The outlet orifice of the nozzle however remains in contact with the upper surface of the box blank whereby the nozzle orifice 42 is wiped clean of excess glue during the term of the passage of the marginal trailing end portion of the box blank through the gap between the downstream end of the shoe and the closed nozzle. I have discovered that this arrangement is very effective in insuring closing of the outlet nozzle of each dispenser fully, in the intervals between box blanks, and in wiping out of the orifice 42 of each nozzle substantially all of the excess glue downstream of the valve seat 43 by the surface of the trailing edge portion of the box blank.

FIGS. 4 through 14 illustrate another embodiment of self wiping fluid dispenser in conjunction with a skip control mechanism for a multi-gun arrangement in which it is desired to dispense stripes of glue along some only of the marginal side flaps of the box blank, or portions only of a given side flap.

Figure 4:
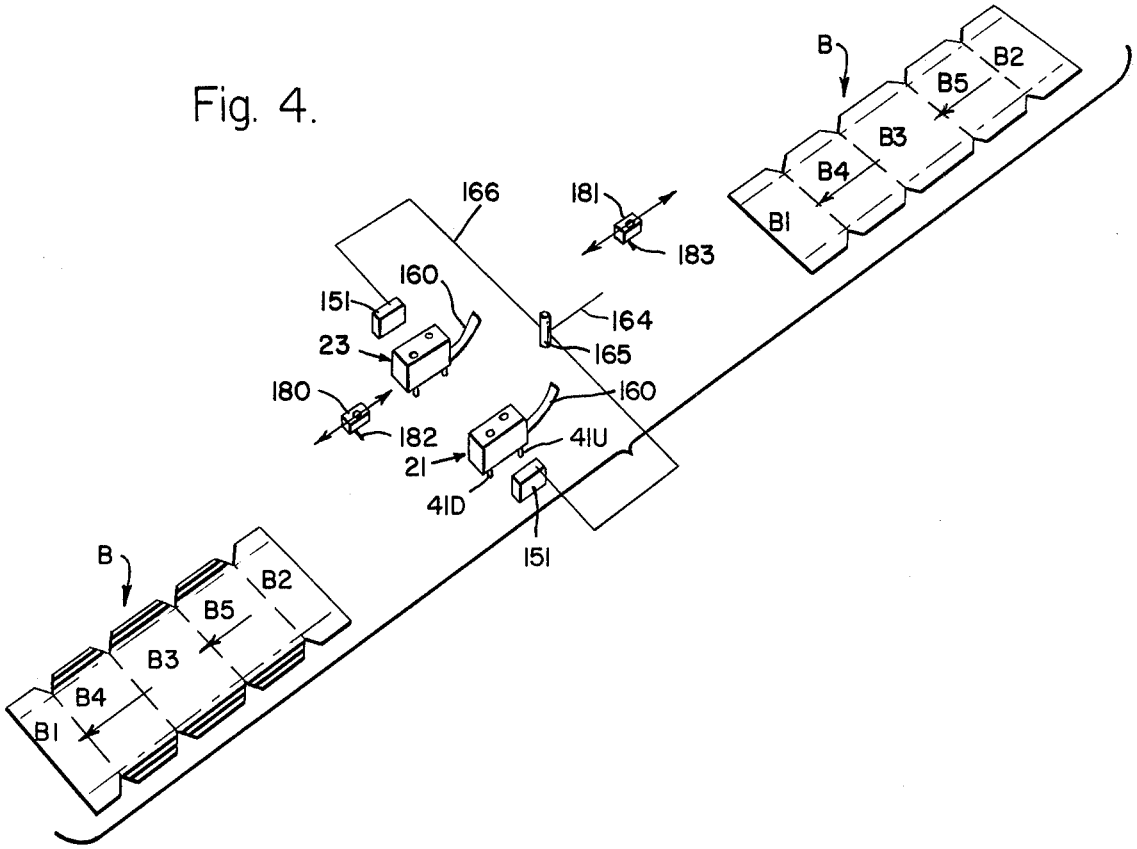
FIG. 4 is a schematic perspective view of another embodiment of the invention as adapted to a skip pattern of delivery of a multiplicity of glue stripes to each of the opposite side marginal flaps of a box blank.

FIG. 4 illustrates a corrugated board body blank B for a container to be formed into what is known as an end seal Bliss or full Bliss box, as contrasted to a top seal Bliss box. The structure of such performed body blanks is well known and will not be described in detail. Suffice it to say that the body blank is appropriately scored and formed with die cut notches to define opposite end panels B1 and B2, an intermediate bottom panel B3, and wall panels B4 and B5 flanking the bottom panel. Each of these panels has opposite side marginal flaps defined therein but in the process of forming the container it is desired to skip the application of glue to the marginal side flaps of the end panels B1 and B2, as illustrated on the left side of FIG. 4. In the schematic illustration of FIG. 4 it will of course be understood that a series of the body blanks are proceeding downstream, as indicated by the directional arrows, through a box making machine that includes a glue applying station at which a pair of the multi-gun dispensers 21 and 23 are located, the internal construction of which is preferably as illustrated in FIG. 2. Typically, the box blanks B are fed through the machine at a lineal speed on the order of 300 feet per minute.

Figure 5:
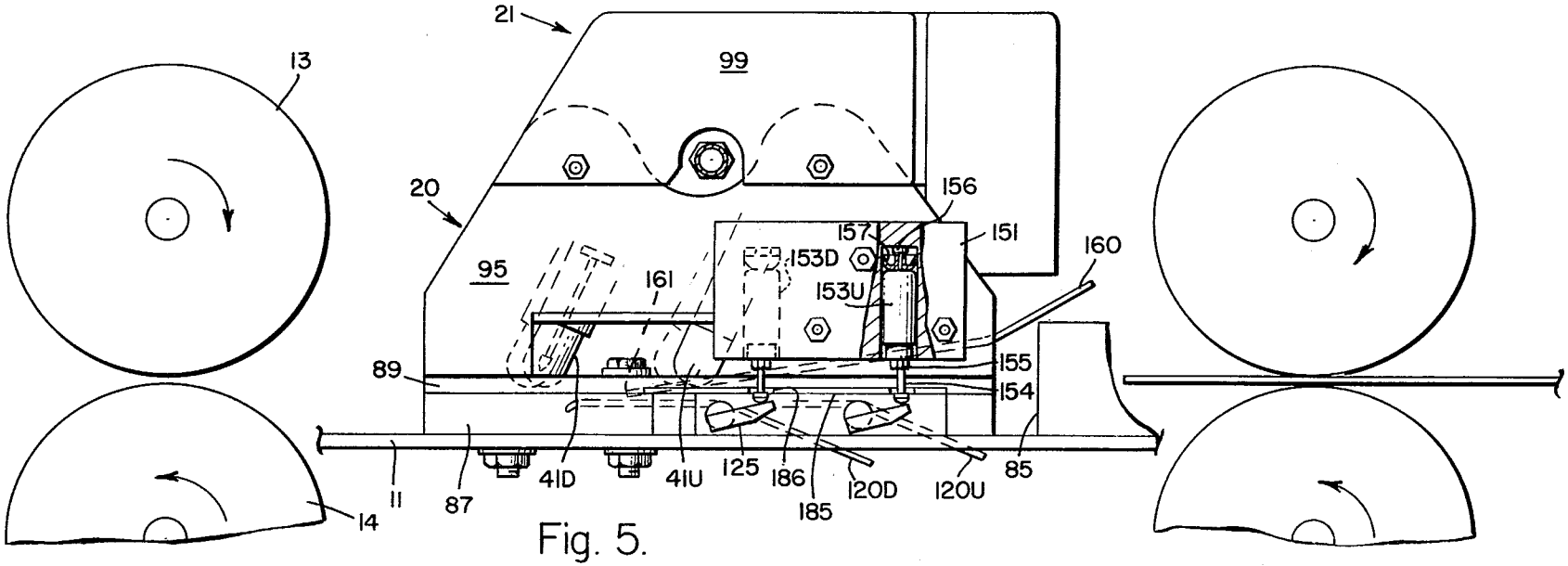
FIG. 5 is a partial side elevational view, on a larger scale, partly in section, of a multiple fluid dispenser assembly of the type used in the embodiment of FIG. 4

Referring to FIG. 5, dispenser 21, for example, is mounted on its bracket assembly 20 at the window 85 of the angle iron guide member 11, i.e., in a location intermediate a pair of the sets of feed rollers 13 and 14. The multi-gun dispenser 21 has a downstream nozzzle 41D and an upstream dispenser nozzle 41U arranged in the staggered tandem relationship schematically shown in FIG. 4. As in the case of the first embodiment, the bracket assembly is adapted to mount a pair of support shoes 120D and 120U each of which is carried at the inner end of a rock shaft 119. In this case, the rock shafts 119 are journaled in a support block 150, comprising a part of the bracket assembly 20, in lieu of the previously described support member 117. Each of the rock shafts 119 at its outer external end has a dog lever 125 rigidly affixed thereto.

A pneumatic cylinder block 151 is secured to the bracket assembly 20 in a location above the pair of dogs 125. The block 151 is formed with a parallel pair of blind bores 152 U and D which telescopically slidably receive actuator pistons 153 U and D, respectively. In its lower end each piston is formed with a tapped blind bore to receive a ball-headed machine screw 154 bearing a jam nut 155 by means of which the extension of the head of the screw downwardly beneath the piston can be adjusted as desired. The upper end of each piston is integrally formed with a reduced diameter head 156 over a necked down portion, whereby to seat an upwardly facing piston cup 157 in air sealing enagagement with the walls of the corresponding cylinder bore 152.

Figure 8:
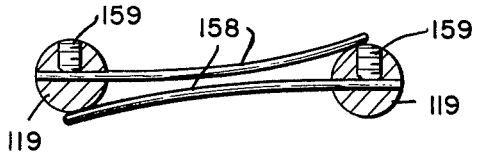
FIG. 8 is a sectional view on the line 8 of FIG. 7.

As is shown in FIG. 8, each of the rock shafts 119 has one end of a spring rod 158 anchored therein by means of a set screw 159. Each of the spring rods 158 has its free end biased against the opposite one of the rock shafts 119 in a manner to produce a torsional moment or torque on each of the rock shafts in a direction to bias the free end of the corresponding dog 125 upwardly against the lower end of each headed screw 154 of the corresponding actuator piston. As will now be seen, by an appropriate adjustment of the jam nuts 155 the angular position of each of the support shoes 120 U, D can be adjusted as desired. In FIG. 5, the pair of support shoes 120 U, D are depicted in a normal retracted inactive position with their downstream ends in a desired vertically adjusted gap relationship to the nozzles 41.

An overhead deflection shoe 160 is secured to the bracket assembly in a manner similar to the deflection shoe 130 of the embodiment of FIG. 2. In this case the deflection shoe 160 has a downstream end 161 terminating approximately midway between the nozzles 41D and 41U and is normally biased in an anticlockwise direction, as viewed in FIG. 5, sufficiently to deflect an entering box blank B downwardly out of the plane through which the box blank would ordinarily be constrained by the nip between adjacent sets of feed roller pairs 13 and 14. Such biasing could, for example, be accomplished by means of a torsion spring and mechanical stop arrangement fitted to the supporting shaft for the deflection shoe 160. However, it is presently preferred to utilize a deflection shoe 160 that is anchored in place on its supporting shaft and is made of a suitable length of spring steel or the like so as to normally occupy the position indicated in FIG. 5, with the downstream end 161 thereof normally positioned a slight vertical distance above the plane occupied by the downstream ends of the pair of retracted support shoes 120.

Referring to FIG. 4, a conduit 164 has communication with a source of compressed air via a solenoid controlled valve 165. A pair of branch conduits 166 have fluid communication with the pair of cylinder blocks 151, each of the latter having a port 167, best seen in FIG. 10, through which the compressed air is delivered and relieved in a controlled sequence from the piston chambers 152U and 152D.

Figure 11:
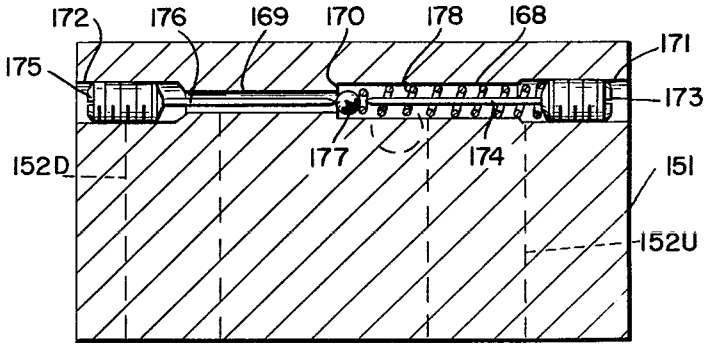
FIG. 11 is a sectional view taken on the line 11—11 of FIG. 10 showing interior details of construction of the time delay mechanism.
Figure 10:
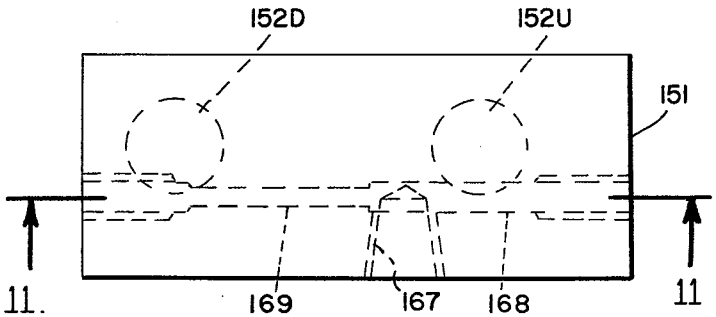
FIG. 10 is a top plan view, on a larger scale, of the pneumatic cylinder control block of the multidispenser of FIG. 5.
Figure 7:
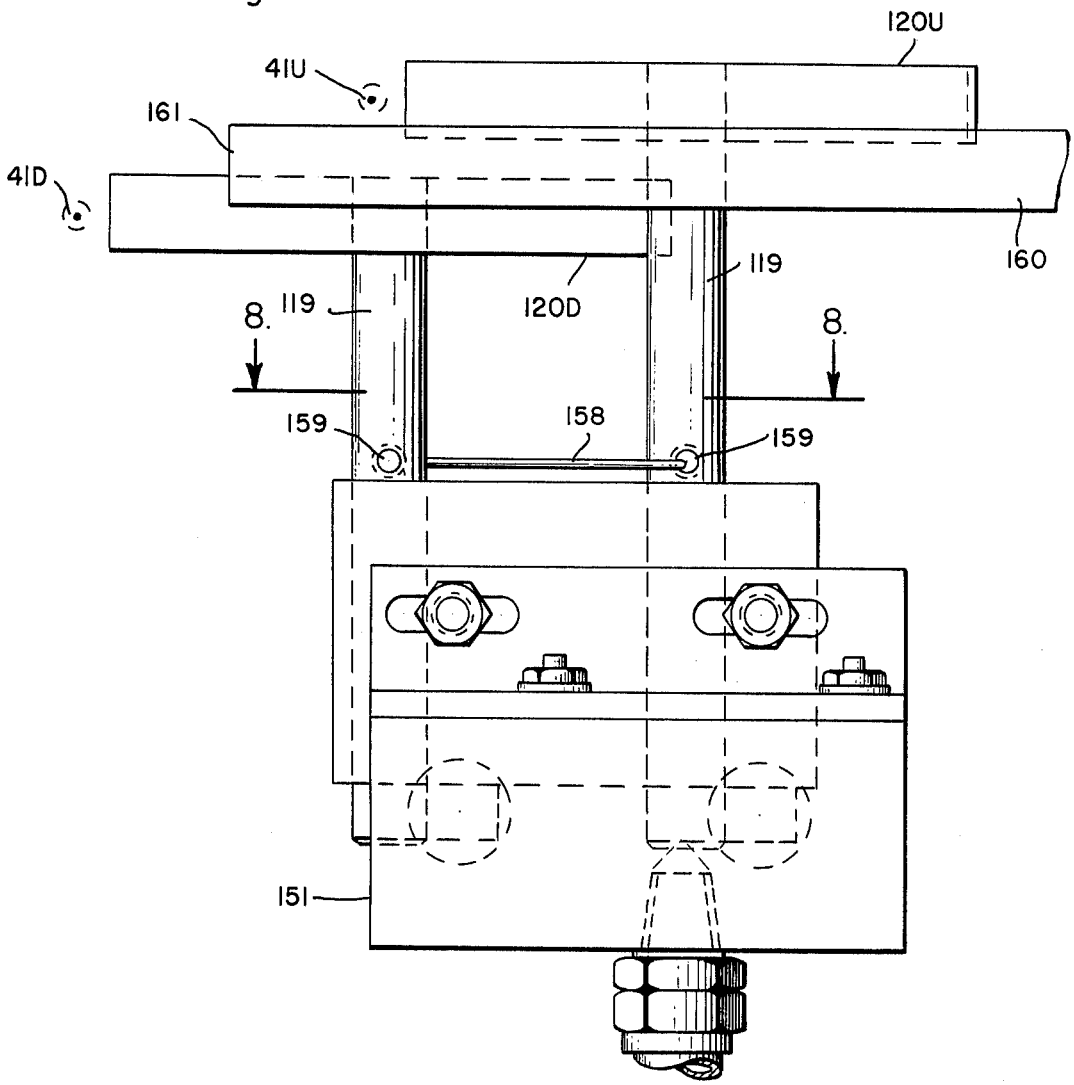
FIG. 7 is a top view of the dispenser assembly of FIG. 5.

Referring to FIGS. 10 and 11, the inner end of the port 167 has fluid communication with a longitudinally extending through bore of the cylinder block 151, the through bore in turn having fluid communication with each of the cylinder chambers 152 U, D. This through bore comprises a step drilled passage having a larger diameter portion 168 in coaxial alignment with a reduced diameter portion 169, the junction of the two passages comprising a seat or shoulder 170. The outermost ends of the passages 168 and 169 comprise tapped portions 171 and 172 respectively. The latter of these threaded portions mounts a trailing skip adjustment screw 173 which carries a slender rod 174 projecting inwardly toward the shoulder 170. In similar fashion, the threaded portion 172 mounts a lead skip adjustment screw 175 which carries a slender rod 176, also projecting toward the shoulder 170. A ball valve 177, of slightly larger diameter than the reduced diameter portion 169 of the through bore, is interposed between the inner adjacent ends of the rods 174 and 176 and is normally biased towards the shoulder or seat 170 by a helical coil spring 178 interposed between the ball valve 177 and the inner face of the trailing skip adjustment screw 173.

As is shown in FIG. 10, the inlet port 167 has direct communication with the larger diameter portion 168 of the through bore of the cylinder block 151. Accordingly, in view of the restriction afforded by the reduced diameter portion 169 of the through bore and the ball valve 177, the upstream actuator piston 153U is normally pressure activated prior to the downstream actuator piston 152D. In the usual case, the skip adjustment screws 173 and 175 are adjusted in such a fashion that the rod 176 of the downstream skip adjustment screw 175 holds the ball slightly unseated from the shoulder 170, the upstream adjustment screw 173 being set to define a gap between the adjacent ends of the rods 174 and 176 slightly larger than the diameter of the ball valve 177. With this arrangement very fine adjustments of the time delay between actuation of the upstream actuator piston 153U and downstream actuator piston 153D can be achieved. In a typical case, assuming box blank B proceeding at a lineal speed of 300 feet per minute, a time delay of 1/30 of a second can be set up between the times of actuation of the two actuator pistons and consequent synchronous actuation of the support shoes 120, with corresponding sequentially synchronous actuation of the dispenser nozzles 41D and 41U.

A stop plate 185 is secured, as by tack welding, on the external margin of the rocker arm support block 150 in a position overlying the pair of dogs 125. As is shown in FIG. 5, this stop plate is formed with a pair of open sided apertures 186, each in alignment with the thrust axis of one of the actuator pistons 153 U, D, providing clearance for the free reciprocation of the actuating screws 154 therethrough but narrower than the jam nuts 155. Accordingly, the stop plate defines the limit of the extension stroke of each of the actuator pistons. At the same time, each of the jam nuts 155 can be adjusted axially of its actuating screw 154 in order to adjust the desired vertical gap relationship between the upper surface of a support shoe and its corresponding nozzle, without affecting the stroke length of the actuating piston. In addition, in some instances wherein it is desirable to eliminate a skip pattern between the leading and trailing edges of a box blank, the pair of screws 154 can be sufficiently extended out of their actuator piston bodies to provide a mechanical means for holding the pair of support shoes in a fully raised extended position, corresponding adjustments being made to the jam nuts 155, and disconnecting the pair of cylinder blocks 151 from their valve controlled source of compressed air.

As is shown in FIG. 4, the solenoid controlled valve 165 is communicated with the source of compressed air or vented to atmosphere under the control of a pair of microswitches 180 and 181. As indicated, each of these switches is mounted on the box making machine for adjustment longitudinally of the machine. The arrangement is such that when the leading downstream edge of a box blank B engages a switch element 182 of the microswitch 180 the valve 165 is communicated with the source of compressed air to effect a cycle of actuation of the pair of actuator pistons of each cylinder block. Then, upon the trailing upstream edge of the box blank B releasing the switch element 183 of the micro-switch 181, the control valve 165 is vented to atmosphere, thus effecting a sequential release of the air pressure in the pair of actuator piston chambers of each of the cylinder blocks 151.

In processing a box blank B to deliver a skip pattern of glue stripes as in FIG. 4, a cycle of operation is as follows.

Before the entry of a blank B into the glue applying station of the machine, the elements of the multi-gun dispenser are in the inactive relative positions shown in FIG. 5. More specifically, the valve 165 is closed so that air under pressure is not present in the chambers 152D and 152U. The corresponding actuator piston 153D and 153U are biased to the fully raised stop or arrested position shown in FIG. 5 by the springs 160 acting torsionally through rock shafts 119 on the pair of dogs 125. Simultaneously, the pair of support shoes 120D and 120U are in the solid outline position depicted in FIG. 5 with their downstream ends in a common plane spaced slightly beneath the plane into which the box blank B would be constrained by the feed rollers pairs 13 and 14. The resiliently flexible top deflection shoe 160 has its downstream end 161 longitdinally disposed approximately midway between the pair of dispenser nozzles 41D and 41U and intersecting the plane of delivery of box blanks B which would be defined by the sets of feed rollers 13 and 14. The nozzles 41D and 41U are disposed in the solid outline position depicted and, also, intersecting the delivery plane defined by the sets of feed rollers.

Referring to FIG. 4, as it is desired to skip or omit the delivery of glue onto the marginal flaps of the leading edge portion B1 of the box blank, the switch 180 is adjusted to a predetermined distance downstream from a nozzle 41U. This distance is empirically determined and is proportional to the longitudinal dimension of the area B1 of the box blank B. Accordingly, the leading edge of the box blank and a length of the portion B1 pass downstream through the gap between the dispenser nozzles and support shoes without effecting deflection of the nozzles and consequent opening of their internal valve mechanism, the box material being deflected downwardly out of the operative plane by the spring loaded deflection shoe 160.

Figure 9:
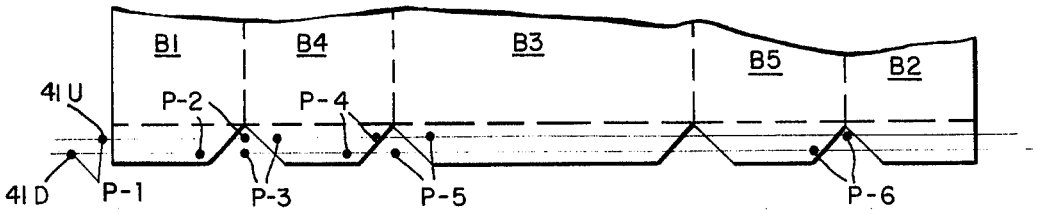
FIG. 9 is a schematic plan view showing a series of different relative positions of the pair of dispenser nozzles and a corrugated board box blank.

In FIG. 9, a series of different relative positions P1 to P6 of the pair of dispenser nozzles and box blank B are depicted. The position P1 is illustrative of the condition illustrated in FIG. 5. When the leading edge of the blank B engages the switch element 182 of the downstream switch 180 the blank and pair of nozzles will have attained approximately the relative position P2, effecting opening of the valve 165 to the source of compressed air. As a result, the upstream actuator piston 153U is driven downwardly effecting angular displacement of the upstream support shoe 120U to the full line position illustrated in FIG. 12, which figure is representative of the relative positions of the illustrated parts in the position P3. The blank B is thus deflected upwardly, against the force of the spring loaded deflection shoe 160, whereby the nozzle 41U is deflected and its valve mechanism opened by the leading edge of the marginal flap of the box portion B4.

Referring to FIG. 11, it will be seen that, due to the restriction afforded by the reduced diameter bore portion 169 and the spring loaded ball valve 177, there will be a delay between the moment of downward actuation of the actuator pistons 153U and 153D, the latter being delayed for a time interval, e.g., 1/5 of a second, dependent upon the adjustment of the two screws 173 and 175. As a result, at position P2 the downstream shoe 120D remains in its retracted position, the extension stroke of the actuator piston 153D and biasing of the shoe 120D not being completed until the relative position P3 is attained.

Figure 14:
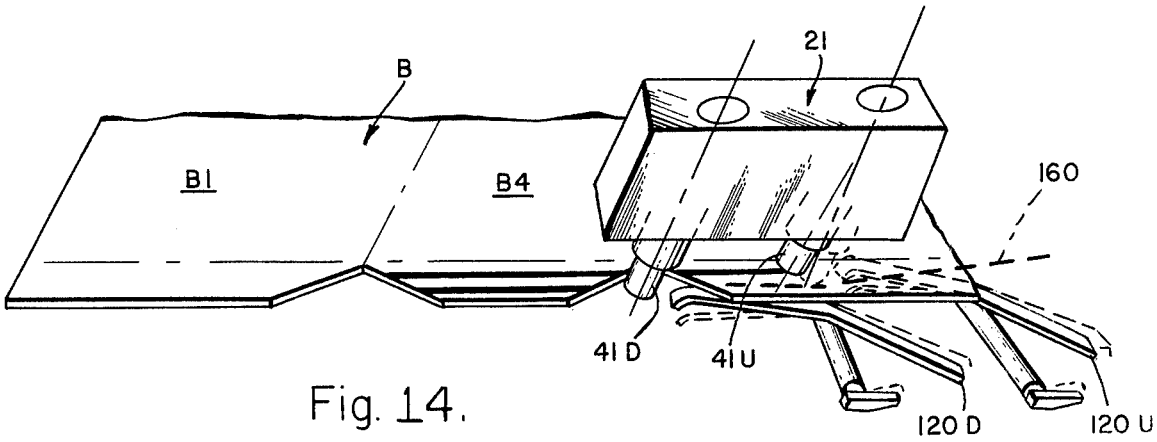
FIG. 14 is a schematic perspective view showing the relative positions of the applicator nozzles and support shoes in yet another phase of the passage of a box blank.
Figure 12:
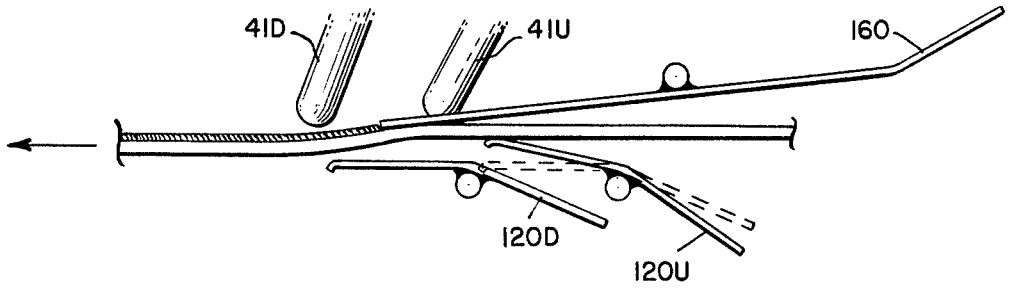
FIG. 12 is a schematic partial elevational view of the relative positions of the applicator nozzles and support shoes during one phase of passage of a box blank therebetween.

As illustrated in FIG. 14 upon both cylinders 152U and 152D being fully and equally pressurized, both support shoes 122U and 122D are maintained in their extended raised positions. This relative positioning of the parts is maintained between the positions P3 and P6 depicted in FIG. 9, effecting the deposit of a pair of glue stripes on the marginal flaps of the box blank portions B4, B3 and B5. However, during this phase, i.e., the interval P3 to P6, each of the nozzles 41U and 41D sequentially returns to the closed position in the open notches between the marginal flaps of body blank portions B4, B3 and B5. Each nozzle also closes just in advance of the trailing edge of the marginal flaps of each of these body blank portions, due to the longitudinally spaced apart gap relationship between each nozzle and its corresponding support shoe. Thus, assuming the position P4, the upstream nozzle 41U is closed even though it is bearing upon a marginal trailing end portion of the flap of the portion B4 since the combined spring force of the deflection shoe 160 and the spring 65 of the corresponding glue gun are sufficient to downwardly deflect the flexible box board material sufficiently to effect closing of the nozzle orifice of the upstream gun. The same wiping and valve closing action occurs with reference to the downstream nozzle 41D each time that it closely approaches or leaves a trailing edge of a marginal flap of the body blank portions B4, B3, and B5, due to the force of its valve spring 65. In the position P5, shown in FIG. 14, the nozzle 41D is fully closed while the nozzle 41U has been deflected to the reopened position by the leading edge of the flap of the portion B3.

The upstream switch 181 is fixed in a longitudinally adjusted position relative to a downstream nozzle 41D emperically, a distance proportional to the longitudinal dimensions of the trailing end portion B2. Thus, when the trailing edge of the body blank B releases the switch element 183 the solenoid control valve 165 is closed to the source of compressed air and vented to atmosphere relieving air pressure in the cylinder block chambers 152U and 152D, also in a time delayed sequence. The upstream cylinder chamber 152U has the more direct and less restrictive communication to atmosphere through the relatively large diameter portion 168 of the bore which vents directly to the port 167. On the other hand, the downstream chamber 152D is vented through the smaller diameter bore portion 169, past the ball valve 177, and then to the port 167. During venting from the downstream chamber 152D the ball 177 is displaced farther from the seat 170 with the spring 178 presenting a light resistance to unseating movement of the ball, to a degree as adjusted by the trailing skip adjustment screw 173.

Figure 13:
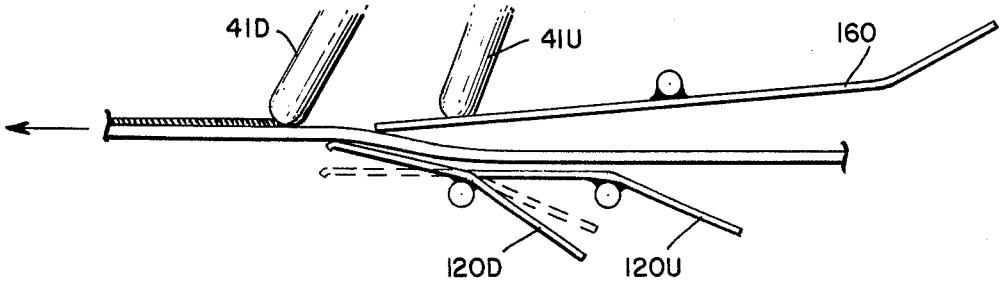
FIG. 13 is a view similar to FIG. 12 but showing the parts in different relative position in another phase of passage of the box blank therethrough.

The longitudinal adjustment of the switch 181 is such that the electrical control circuit for the solenoid controlled valve 165 is opened at approximately the relative position P6 depicted in FIG. 9, which is also illustrated in FIG. 13. Thus, when the upstream nozzle 41U is disposed in the notch between the box portions B5 and B2 the corresponding cylinder chamber 152U is vented atmosphere, allowing the associated spring 158 to return the upstream support shoe 120U to the retracted solid outline position of FIG. 13. Simultaneously, because of the time delay in venting to atmosphere from the downstream chamber 152D, the downstream 120D remains raised and extended in the solid outline position of FIG. 13, gradually retracting to the dotted outline position shown during relative movement of the downstream nozzle 41D along the trailing end portion of the marginal flap of the portion B5, so that upon departure of the nozzle 41D from this flap both support shoes are fully retracted. Consequently, the deflection shoe 160 effects deflection of the box board beneath the operative plane of intersection with the pair of nozzles 41 so that no glue stripes are deposited on the marginal flaps of the box blank portion B2.

The embodiment of the invention illustrated in FIGS. 4–14 is of particular utility in the illustrated tandem glue gun arrangement wherein it has the important advantage of opening and closing the pair of dispenser nozzles in a controlled time delay sequence, with a single control system. The advantage is achieved irrespective of whether or not the particular box blank being processed is of a type in which a skip pattern of glue strips is desired. However, it will also be understood by those skilled in the art that the skip control mechanism of the invention may also be utilized in situations where but a single dispenser nozzle is employed at each of the opposite side marginal flaps of the box blank being processed. Stated otherwise, with reference to FIG. 4, if it be assumed that, for example, the pair of downstream nozzles 41D is omitted, the pair of switches 180 and 181 may both be adjusted with reference to the remaining single nozzles, e.g., nozzles 41U, so that single beads of glue are deposited only on intermediate portions of the box blank and not on the opposite end portions, e.g., the portions B1 and B2.

With reference to the example illustrated in FIG. 4, it has been noted that the pair of switches 180 and 181 are adjusted relative to the leading and trailing edges of the box blank B. It should be further understood that the pair of switches are connected in electrical series such that when the leading edge of a body blank B engages the switch element 183 of the upstream switch 181 and then the switch element 182 of the downstream switch 180 the circuit is closed to activate the solenoid controlled valve 165. The longitudinal spacing between the pre-adjusted switches 180 and 181 being less than the longitudinal dimension of the body blank B, upon a trailing edge of the body blank passing and being released from the switch element 183 of the upstream switch 181 the circuit opens to de-energize the solenoid controlled valve 165, with consequent retraction of the support shoes to their inactive positions. It will be understood that this control circuit is illustrative only. For example, the pair of switches may be so located and the electrical control circuit so varied whereby switch opening and closing is a function of leading and trailing edge of other portions, e.g., the marginal flaps of portion B3 of the box blank B. As another alternative, a holding relay could be incorporated into the electrical circuitry such that the application of glue is skipped within the longitudinal length of a given marginal flap of the blank B, e.g., a skipped intermediate portion of the marginal flap of the portion B3.

It will also be appreciated in the second embodiment of the invention that a wiping action of the nozzle on a trailing marginal portion of a box flap may be achieved irrespective of any longitudinal gap distance between a nozzle and its corresponding support shoe. Thus, with reference to either of FIGS. 12 and 13, assuming the presence of but a single dispenser nozzle and a corresponding support shoe in direct opposition to one another, it will be apparent that upon movement of the support shoe to a retracted position at a moment just in advance of or coincident with passage of a trailing end box portion under the nozzle orifice, the nozzle valve spring and the overhead spring biased deflection shoe 160 effect downward deflection or biasing of the box board and return of the nozzle to the valve closed position.

While specific embodiments of the invention have been described and illustrated in detail it will be understood that these are intended to be illustrative and not limitative of the invention claimed.

I claim:

1. Apparatus for applying a fluid to successive box blanks or the like comprising:

a framework having longitudinally spaced apart sets of means engagable with opposite sides of a box blank for feeding successive box blanks in a predetemined direction of travel in a predetermine plane;

a fluid dispenser on said framework, said dispenser movably mounting a rigid nozzle barrel that is normally disposed to intercept said plane, said nozzle barrel being deflectable by the leading edge of a box blank to thereafter bear against one side of the box blank, said nozzle barrel being located longitudinally intermediate an adjacent pair of sets of said longitudinally spaced apart sets of feeding means;

a support shoe mounted to bear against the opposite side of the box blank at a position longitudinally aligned a predetermined gap distance upstream from said nozzle barrel and against which the box blank reacts, during passage thereover, to hold said nozzle barrel in a deflected position against one side of the box blank, a normally closed valve means in said dispenser that is adapted to open upon deflection of said nozzle barrel to pass a fluid through an outlet orifice nozzle thereof to be deposited on one side of the box blank;

means biasing said nozzle barrel to normal position that yields to permit deflection of said nozzle barrel and opening of said valve means upon engagement of said nozzle barrel by a leading edge of a box blank reacting against said support shoe, said biasing means effecting return of said nozzle barrel to a normal position and of said valve means to normally closed position concurrently with a trailing edge of the box blank leaving said support shoe, whereupon a trailing end portion of the box blank is deflected by said rigid nozzle barrel, whereby said closed nozzle barrel is wiped on the deflected trailing end portion of the box blank for a distance substantially equal to said predetermined distance; and said dispenser and said support shoe being mounted on a common bracket having means to adjust said predetermined gap distance between said nozzle barrel and said support shoe, whereby to vary the wiping distance of engagement of said nozzle barrel and the deflected trailing end portion of the box blank.

2. Apparatus for applying a fluid to successive box blanks or the like comprising:

a dispenser body;

a fluid dispenser mounted in said body and movably mounting a rigid nozzle barrel protruding beyond the exterior of said body;

a bracket assembly for interconnecting said body to one side of a box blank handling machine in a position in which said nozzle barrel normally intersects a predetermined plane to be engagable with one side of a box blank;

a support shoe carried on a rockable shaft of said bracket assembly in a position to engage the other side of the box blank at a predetermined gap distance upstream from said nozzle barrel to constrain the box blank to the predetermined plane;

said bracket assembly having stop means to unidirectionally positively limit rocking of said shaft to correspondingly limit movement of said shoe in a direction normal to the predetermined plane and away from said nozzle barrel;

valve means in said dispenser;

said means biasing said nozzle barrel to normal position that yields to permit deflection of said nozzle barrel to open said valve means upon engagement of said nozzle barrel by a leading edge of a box blank reacting against said support shoe, said biasing means effecting return of said nozzle barrel to normal position and closure of said valve means concurrently with a trailing edge of the box blank leaving said support shoe and entering said predetermined gap distance whereupon a trailing end portion of the box blank is deflected by said rigid nozzle barrel, whereby said closed nozzle barrel is wiped on the deflected trailing end portion of the box blank for a distance substantially equal to said predetermined gap distance.

3. Apparatus for applying a fluid to successive box blanks or the like comprising:

a bracket means;

a fluid dispenser and a support shoe mounted on said bracket means to bear on opposite sides of a box blank passing therebetween;

said dispenser having means yieldably biasing a movably mounted rigid nozzle barrel of said dispenser to a normal position to intercept a leading edge of a box blank passing between said dispenser and said support shoe;

a normally closed valve means in said dispenser that is adapted to open upon deflection of said nozzle barrel to pass a fluid through an outlet orifice nozzle thereof to be deposited on one side of the box blank;

and means, including said nozzle barrel biasing means, to effect return of said nozzle barrel to normal position and closing of said valve means at least in advance of a trailing edge of said box blank passing downstream beyond said nozzle barrel whereupon a trailing end portion of the box blank is deflected by said rigid nozzle barrel and said closed nozzle is wiped on the deflected trailing end portion of the box blank;

said last mentioned means comprising a rockably mounted support shoe having an end movable between extended and retracted positions, said retracted position providing clearance for deflection of the trailing end portion of the box blank by said nozzle barrel biasing means, said shoe in said extended position constraining a leading edge of the box blank to a plane for effecting deflection of said nozzle barrel.

4. Apparatus as in claim 3 in which said last mentioned means further comprises a predetermined longitudinally spaced gap relationship between said nozzle barrel and said support shoe.

5. Apparatus as in claim 3 that includes controllable means for effecting movement of said rockable shoe between extended and retracted positions.

6. Apparatus as in claim 5 in which said bracket assembly mounts a deflection shoe yieldably biased against the same side of the box blank against which said nozzle barrel is biased.

7. Apparatus for applying a fluid to successive box blanks of a yieldable material or the like comprising:

a deflectable fluid dispensing nozzle and a movably mounted support shoe mounted in proximity to one another for concurrent engagement with opposite sides of a box blank moving therebetween whenever said support shoe is moved to an extended position;

controllable means operatively associated with said support shoe for moving said support shoe between said extended position and a retracted position out of contact with the corresponding side of the box blank;

a normally closed valve means for said dispenser nozzle that opens upon deflection of said nozzle to pass a fluid through an outlet orifice thereof to be deposited on the corresponding side of the box blank;

means to yieldably bias that portion of the box blank moving between said nozzle and said support shoe into a plane out of deflecting contact with said nozzle;

said biasing means yielding upon movement of said support shoe to said extended position by said controllable means, with consequent corresponding deflection of the box blank and deflection and opening of said nozzle.

8. Apparatus as in claim 7 in which said biasing means comprises a portion of said normally closed valve means for said dispenser nozzle.

9. Apparatus as in claim 7 having biasing means operatively associated with said nozzle to yieldably resist deflection of said nozzle and consequent opening of said valve means.

10. Apparatus as in claim 7 in which said biasing means comprises a deflection shoe mounted in opposing relation to said support shoe.

11. Apparatus as in claim 7 in which:

said support shoe is mounted a predetermine longitudinal gap distance upstream from said nozzle, said apparatus having means biasing said valve means to said normally closed condition and yieldably resisting deflection of said nozzle.

12. Apparatus as in claim 7 in which said support shoe is rockably mounted and has a downstream end, in proximity to said nozzle, movable between said extended and retracted position, said shoe being normally biased to said retracted position.

13. Apparatus as in claim 7 in which said controllable means comprises a support shoe biasing means and a power means for positively displacing said support shoe.

14. Apparatus as in claim 7 in which said support shoe is normally biased to said retracted position, said controllable means including a power emans for positively displacing said shoe to said extended position.

15. Apparatus as in claim 7 in which said controllable means is adapted for movement of said support shoe to said extended position during a portion only of the passage of a body blank over said support shoe, with consequent deflection of the box blank and deflection and opening of said nozzle for depositing fluid on a portion only of the length of the box blank.

16. Apparatus for applying fluid to successive box blanks of a yieldable material or the like comprising:

a plurality of laterally and longitudinally offset fluid dispensers each having a deflectable nozzle and a normally closed valve means adapted to open upon deflection of said nozzle to pass a fluid through an outlet orifice thereof;

a plurality of laterally and longitudinally offset support shoes each being mounted in proximity to one of said nozzles on the opposite side of a box blank from said nozzle;

means supporting said support shoes for movement independently of one another between extended and retracted positions of said support shoes;

means that bias that portion of the box blank moving between said nozzles and said support shoes into a plane out of deflecting contact with said nozzles when said support shoes are in retracted positions; and controllable means for sequentially moving said support shoes between extended and retracted positions, each of said extended support shoes effecting deflection of the box blank and consequent corresponding deflection and opening of the valve means of the corresponding one of said nozzles.

17. Apparatus as in claim 16 in which said means for biasing the box blank comprises a deflection shoe having a downstream end terminating approximately longitudinally midway between a pair of said nozzles.

18. Apparatus as in claim 16 in which each of said support shoes is normally biased to retracted position, said controllable means comprising power means to sequentially positively displace said support shoes to extended positions when said power means is energized, said support shoes sequentially returning to normally retracted positions upon de-energization of said power means.

19. Apparatus as in claim 18 in which said power means comprises a fluid powered piston for each of said support shoes, the plurality of said pistons having chambers in fluid communication with a common valve controlled source of fluid pressure at different fluid flow rates.

20. Apparatus as in claim 19 including a fluid flow restrictor for one of said chambers comprising an unseated valve member that is yieldably biased toward a seat adjacent to said valve member to yieldably oppose relief of fluid pressure from said one chamber upon de-energization of said power means.

21. Apparatus as in claim 20 in which valve member comprises a ball positioned between adjacent ends of a coaxially aligned pair of opposed rods, said inner ends defining a gap delimiting the range of displacement of said ball relative to said seat, one of said rods serving to maintain said ball in said unseated condition, the other of said rods mounting a spring means yieldably biasing said ball toward said seat and against the inner end of the first one of said rods.

22. Apparatus as in claim 18 in which said controllable means comprises a longitudinally spaced pair of sensor elements engagable and disengagable by leading and trailing edge of different portions of a box blank to initiate and terminate a cycle of operation of said power means.

23. Apparatus as in claim 16 in which each of said support shoes is longitudinally offset upstream of a predetermined gap distance from the corresponding one of said nozzles.

* * * * *